US007288180B2

(12) United States Patent
Tojo et al.

(10) Patent No.: US 7,288,180 B2
(45) Date of Patent: Oct. 30, 2007

(54) ELECTRIC CURRENT CONTROL METHOD AND APPARATUS FOR USE IN GAS GENERATORS

(75) Inventors: Tetsuro Tojo, Osaka (JP); Jiro Hiraiwa, Osaka (JP); Osamu Yoshimoto, Osaka (JP)

(73) Assignee: Toyo Tanso Co., Ltd., Osaki-shi (JP)

( * ) Notice: Subject to any disclaimer, the term of this patent is extended or adjusted under 35 U.S.C. 154(b) by 441 days.

(21) Appl. No.: 10/849,174

(22) Filed: May 20, 2004

(65) Prior Publication Data

US 2004/0238374 A1 Dec. 2, 2004

(30) Foreign Application Priority Data

May 28, 2003 (JP) ..... 2003-150474

(51) Int. Cl.
*C25C 3/20* (2006.01)

(52) U.S. Cl. ..... 205/336; 205/337; 205/354; 205/356; 205/619; 204/228.1; 204/229.8; 204/230.2; 204/243.1

(58) Field of Classification Search ..... 205/619, 205/354, 356, 336, 337; 204/228.1, 229.8, 204/230.2, 243.1
See application file for complete search history.

(56) References Cited

U.S. PATENT DOCUMENTS

| | | | | |
|---|---|---|---|---|
| 2,540,248 | A | 2/1951 | Downing | |
| 4,822,469 | A * | 4/1989 | Shimomura et al. | 204/228.5 |
| 6,818,105 | B2 * | 11/2004 | Tojo et al. | 204/240 |
| 2004/0007457 | A1 * | 1/2004 | Tojo et al. | 204/247 |
| 2004/0055874 | A1 * | 3/2004 | Hiraiwa et al. | 204/250 |
| 2004/0099537 | A1 * | 5/2004 | Hiraiwa et al. | 205/411 |
| 2004/0108201 | A1 * | 6/2004 | Tojo et al. | 204/243.1 |
| 2005/0006248 | A1 * | 1/2005 | Tojo et al. | 205/619 |
| 2005/0011766 | A1 * | 1/2005 | Tojo et al. | 205/81 |
| 2005/0161321 | A1 * | 7/2005 | Kennedy et al. | 204/277 |

FOREIGN PATENT DOCUMENTS

| | | |
|---|---|---|
| JP | 57-54286 | 3/1982 |
| JP | 5-51779 | 3/1993 |

* cited by examiner

*Primary Examiner*—Bruce F. Bell
(74) *Attorney, Agent, or Firm*—Oblon, Spivak, McClelland, Maier & Neustadt, P.C.

(57) ABSTRACT

The invention provides a method and apparatus for current control in gas generators capable of generating a fluorine or fluoride gas by and in which the electrolysis can be maintained in an optimum condition, stable operation is possible and no manpower is demanded. According to the method of current control in gas generators for generating a fluorine or fluoride gas by electrolysis of an electrolytic bath 5 comprising a hydrogen fluoride-containing mixed molten salt using a carbon electrode as the anode 4*a*, the range of voltage fluctuation between the cathode 4*b* and anode 4*a* as occurring when a certain current is applied to the gas generator is measured, and current application is continued while varying the current amount to be applied according to the voltage fluctuation range.

8 Claims, 4 Drawing Sheets

ELECTRIC CURRENT CONTROL METHOD AND APPARATUS FOR USE IN GAS GENERATORS

BACKGROUND OF THE INVENTION

1. Field of the Invention

This invention relates to a method and an apparatus for electric current control in gas generators which generate a fluorine or fluoride gas.

2. Description of the Related Art

Conventionally, fluorine is produced by electrolysis of a molten salt containing a fluoride such as HF, as shown in the equation (1):

$$F^- \rightarrow \tfrac{1}{2}F_2 + e^- \quad \text{(1) (fluorine generation reaction).}$$

On that occasion, hydrogen is generated from the cathode, as shown by the equation (2):

$$2H^+ + 2e^- \rightarrow H_2 \quad \text{(2) (hydrogen generation reaction).}$$

However, among the reactions shown above by the equations (1) and (2), the fluorine generation reaction, which occurs on the anode, is accompanied by very complicated side reactions, as shown by the equations (3) to (10):

$$xC + F^- \rightarrow (CF_x)^+ + e^- \quad \text{(3) (fluorine carbon intercalation compound formation reaction)}$$

The reaction shown by the equation (3) is a reaction proceeding within electrode carbon crystals, by which reaction the surface energy of the crystals increases and the wetting thereof with the electrolytic bath is improved and, further, the conductivity thereof as the electrode is improved as a result of hole conduction caused by hole creation within the crystals by drawing of $\pi$ electron on carbon atom toward fluorine atoms.

$$C + 2F_2 \rightarrow CF_4 \quad \text{(4) (carbon tetrafluoride formation reaction)}$$

The reaction represented by the equation (4) indicates that the fluorine gas generated by electrolysis reacts with carbon atoms electrode surface to generate the carbon tetrafluoride gas. This gas, when it enters a fluorine-containing gas, in particular the fluorine gas, becomes an impurity and reduces the purity of the fluorine gas. This gas is close in such properties as boiling point to the fluorine gas and therefore is difficult to eliminate from the fluorine gas. Thus, the use of a carbon anode hardly allowing this reaction to occur is preferred from the high purity gas generation viewpoint.

$$2H_2O \rightarrow O_2 + 4H^+ + 4e^- \quad \text{(5) (oxygen generation reaction)}$$

$$xC + \tfrac{1}{2}O_2 \rightarrow C_xO \quad \text{(6) (graphite oxide formation reaction)}$$

$$2xC + yF_2 \rightarrow (CF)_x \quad \text{(7) (graphite fluoride generation reaction)}$$

The equations (5) to (7) indicate a series of reactions. When water, which is lower in discharge potential than HF, is present in the electrolytic bath, water is electrolyzed according to the equation (5) before HF. The oxygen generated by this electrolytic reaction reacts with the electrode carbon to form graphite oxide according to the equation (6). This compound is unstable and the fluorine generated according to the equation (1) readily substitutes for the oxygen of this compound to generate graphite fluoride, as shown by the equation (7).

Graphite fluoride is very low in surface energy and, when graphite fluoride is formed on the electrode surface, that portion cannot come into contact with the electrolytic bath, causing polarization, which inhibits the progress of the electrolytic reaction. When the coverage of graphite fluoride, which is very low in surface energy, as mentioned above, exceeds 20% relative to the electrode surface area, the electrode surface will not be wetted with the electrolytic bath at all but the so-called "anode effect" condition will result. More specifically, the electrode cannot come into contact with the electrolytic bath, so that the resistance of the electrode surface becomes infinite and the path of the electrolytic current is thus barred, with the result that the electrolytic potential rapidly increases and a state arises in which electrolysis is no more possible at all.

This reaction tends to occur when the water content is high in the electrolytic bath, for example just after preparation of the electrolytic bath or just after starting of feeding of hydrogen fluoride as the raw material. When the increase in the current to be applied to the effective electrode surface area is excessive in electrolytic current application, too, these reactions tend to occur.

As the HF in the electrolytic bath is consumed, the HF concentration in the electrolytic bath comprising KF·xHF lowers and, when x becomes lower than 1.8, the ice point rises to 100° C. or above and the electrolytic bath precipitates out on the anode and cathode, respectively, at a controlled temperature of 90° C. to 100° C. under the operation conditions of the electrolyzer; in many cases, it precipitates out on the cathode (cylinder or nickel) rather than on the anode where graphite fluoride is formed according to the equation (7). When this phenomenon occurs, the bath voltage increases due to an increase in cathode resistance. This increase in bath voltage is a problem that can be solved by adjusting the HF concentration in the electrolytic bath to a predetermined level. However, once the melting point of the bath has risen and solidification has occurred, it is difficult to melt again the bath that has solidified in the electrolyzer. Therefore, once such a phenomenon has occurred, a much longer time is required for adjusting the HF concentration in a solidified portion as compared with HF concentration adjustment in the ordinary electrolytic bath that is in a molten state.

$$Fe^{2+} \rightarrow + Fe^{3+} + e^- \quad \text{(8) (oxidation reaction of iron ions eluted)}$$

$$Ni^{2+} \rightarrow + Ni^{4+} + 2e^- \quad \text{(9) (oxidation reaction of nickel ions eluted)}$$

As shown by the equations (8) and (9), the iron and/or nickel ions electrochemically eluted from the structural materials of the electrolyzer are further oxidized on the anode to give $Fe^{3+}$ or $Ni^{4+}$. If the fluorides of these ions are present in the bath, they form complexes with KF. These complexes adhere to the anode in the manner of electrophoresis during electrolysis. These insulating deposits cause polarization on the anode. The phenomenon occurring during operation includes fluctuations and/or a slow rise in bath voltage. Further, when the contents of these impurities in the electrolytic bath increase, the viscosity of the electrolytic bath increases and splash entrainment tends to occur readily. When splash entrainment occurs, the electrolytic bath composition fluctuates with the lapse of time, possibly causing choking in piping portions and/or causing fluctuations in pressure in the electrolyzer.

$$\tfrac{1}{2}F_2 + \tfrac{1}{2}H_2 \rightarrow HF \quad \text{(10) (reduction reaction of } H_2 \text{ and } F_2\text{)}$$

The reaction according to the equation (10) occurs when fluorine gas and hydrogen gas mix with each other. When this reaction occurs in the electrolytic bath, raw material recovery results, and the current efficiency in the fluorine generation reaction lowers. In any case, this is a reaction unfavorable for the maintenance of the main reaction in the electrolysis.

The reactions according to the above equations (1) to (10) except for the equation (2) occur on the anode. On the anode surface where such competitive reactions proceed, the surface conditions, inclusive of gas desorption and adsorption, are always changing, and this results in fluctuations in bath voltage relative to the current applied. Under such circumstances, a method of current application as resulting from due consideration of these reactions should be carried out so that fluorine may be generated smoothly with a current efficiency of 95% or higher even when use is made of a bath conditioned to sufficiently remove $H_2O$ in the bath.

In the case of industrial electrolyzers in ordinary use, the operation conditions are manually controlled, and watchmen adjust the operation conditions after observation by them of some or other noticeable abnormality, such as an abnormality in electrolytic voltage. Thus, they can operate only allopathically. Under the existing circumstances, when the electrolysis condition is found worsened, they lower the output repeatedly and, finally, they stop the electrolysis for repairing. At the time of stopping the electrolysis, the electrode is also found damaged in many instances, hence electrode replacement becomes essential. When, on that occasion, the suspension period and the manpower required for repairing and other factors are taken into consideration, this repair work costs very much. Considering these together, it is necessary to always monitor the electrolyzer condition automatically by means of a control system, not by watchmen, so that the electrolyzer may be operated stably while preventing any factors from inhibiting the electrolysis in accordance with the electrolyzer condition.

Under such circumstances, automatic operation has been attempted, for example, by on/off operations, depending on the bath liquid level, of the current supply means placed under the control of signals from a bath liquid level sensor provided within the electrolyzer so that the electrolysis conditions may be controlled and the liquid level may be maintained at a constant level (cf. e.g. JP Kohyo H09-505853).

However, as for the method described in the above-cited patent document, the current situation is that operators on site monitor the state of electrolysis and control the electrolysis conditions according to changes therein until it becomes possible to effect stable gas generation.

It is an object of the present invention, which has been made in view of the problems discussed above, to provide a method and an apparatus for current control in gas generators capable of generating a fluorine or fluoride gas by which method and apparatus the electrolysis can be maintained in an optimum state and stable operation is made possible without requiring manpower.

SUMMARY OF THE INVENTION

The present inventors made intensive investigations in an attempt to solve the above problems and, as a result, found a method of operating the electrolyzer always stably by measuring the electrolytic voltage between the anode and cathode during electrolysis, precisely monitoring the voltage fluctuation range, thereby estimating the state within the electrolyzer, minutely determining the electrolysis conditions based on that estimation, and realizing them. They further developed a control apparatus in which the above method is employed and which can monitor the state of the electrolyzer always automatically without manpower and can prevent electrolysis-inhibiting factors to thereby enable stable operation. Thus, they have completed the present invention.

In an aspect, the method of current control in gas generators generating a fluorine or fluoride gas according to the invention is a method of current control in a gas generator generating a fluorine or fluoride gas by electrolysis of an electrolytic bath comprising a hydrogen fluoride-containing mixed molten salt using a carbon electrode as the anode and is characterized in that the range of voltage fluctuation between the cathode and anode when a certain current is applied to the gas generator and current application is carried out while varying the level thereof according to the voltage fluctuation range.

When, in carrying out electrolysis in the gas generator generating a fluorine or fluoride gas, a constant current is applied between the anode and cathode, the range of electrolytic voltage fluctuation between the anode and cathode, which is one of the electrolysis conditions, is measured. When the fluctuation range is narrow, it can be confirmed that the electrolytic state is normal; hence, a certain current can be further applied. In case of an abnormality during electrolysis, the abnormality manifests itself mostly as an increase in the electrolytic voltage fluctuation range. In that case, this is recognized as the occurrence of an abnormality in the gas generator and further current supply is once suspended according to the largeness of the electrolytic voltage fluctuation range for confirmation of the actual state, or it is possible to reduce the certain current as compared with that applied so far and confirm whether an abnormality still occurs in that state.

In another aspect, the method of current control in gas generators generating a fluorine or fluoride gas according to the invention is a method of current control in a gas generator generating a fluorine or fluoride gas by electrolysis of an electrolytic bath comprising a hydrogen fluoride-containing mixed molten salt using a carbon electrode as the anode and is characterized in that the range of voltage fluctuation between the cathode and anode when a certain current is applied to the gas generator is measured and current application is carried out to attain a target operation current level while varying the level thereof according to the voltage fluctuation range.

By repeating the operation of applying a constant current while repeating the above method of the invention, it becomes possible to increase the current to be applied until a final target operation current level while repeatedly confirming that there is no abnormality in electrolysis condition. As a result, a fluorine or fluoride gas can be generated very safely. The term "target operation current level" as used herein means a necessary and sufficient current value to be applied between the anode and cathode for generating a required gas amount within the range up to a maximum current capacity applicable between the anode and cathode by the electrolytic power source of the generator.

In a further aspect, the method of current control in gas generators generating a fluorine or fluoride gas according to the invention comprises measuring the range of voltage fluctuation between the anode and cathode and varying the current to be applied according to the voltage fluctuation range to thereby continue the electrolysis further after arrival of the current application at the target operation current level.

Thus, in the above-mentioned case of abnormality occurrence during electrolysis, the abnormality manifests itself mostly as an increase or decrease in the range of voltage fluctuation between the anode and cathode. In that case, it is recognized that there is an abnormality in the gas generator; and the current level is reduced as compared with the operation current. On that occasion, the method of current control in gas generators comprises repeating the same operation as in the second aspect and carrying out current application again until the target operation current level is arrived at. In continuing steady electrolysis for continuous gas generation after current application to the target operation current level, that the electrolysis state is normal can be confirmed by measuring the range of voltage fluctuation between the anode and cathode and confirming that the fluctuation range is within a predetermined range of voltage fluctuation; the operation current can then be continuously applied.

In a further aspect, the method of current control in gas generators generating a fluorine or fluoride gas according to the invention comprises carrying out current application until a predetermined value level while repeatedly increasing, decreasing or maintaining the current to be applied.

Thus, in the case of abnormality occurrence during electrolysis, the abnormality manifests itself mostly as an increase or decrease in the range of voltage fluctuation between the anode and cathode. In that case, it is recognized that there is an abnormality in the gas generator; the method of current control in gas generators thus comprises either suspending further current application for confirming the actual state, or decreasing the current as compared with the level applied previously to confirm whether there is still an abnormality in that state. Therefore, even when a current level lower than the operation current is selected and current application is carried out until that selected value, the range of voltage fluctuation between the anode and cathode is measured and, when the fluctuation range is within a predetermined voltage fluctuation range, it can be confirmed that the state of electrolysis is normal, hence further certain current application is possible.

In a further aspect of the method of current control in gas generators generating a fluorine or fluoride gas according to the invention, the current to be applied at a time is not more than 5 $A/dm^2$ relative to the effective electrolysis surface area on the anode.

If an excessive current is applied at a time because of hastened production on the production site in a gas generator generating a fluorine or fluoride gas, the rate of formation of $(CF)_n$, which causes polarization, according to the equation (7) among the reactions indicated by the equations (4) to (10) increases, hence polarization will be caused. In case of occurrence of this abnormality, it is difficult to detect the electrolytic voltage fluctuation based on an abnormality due to a worsened electrode condition since the change due to current application is too rapid even when the electrolytic voltage between the anode and cathode is being measured. Even if this abnormality can be detected, the symptoms are already in a worst condition, so that it is difficult to avoid or eliminate the abnormal state or bring about a recovery from that state by reducing the current, for instance. If the current to be applied at a time is excessively small, a very long period of time is required to attain the target operation current level and may cause a delay in required gas supply. Therefore, the current to be applied at a time should be not more than 5 $A/dm^2$, preferably within the range of 1 to 3 $A/dm^2$, relative to the effective electrolytic surface area on the anode, whereby any delay in detection or worsening in condition can be prevented.

In a further aspect of the method of current control in gas generators generating a fluorine or fluoride gas according to the invention, there are provided a plurality of independent power sources.

In large gas generators for generating a fluorine or fluoride gas whose current capacity is 1,000 A to 5,000 A, for instance, the electrodes generally comprise 10 to 32 plates. As for the method of electrode mounting, one to ten plates are fixed to each of a plurality of current collectors. Therefore, in case of the occurrence of an abnormality, the state thereof can be detected by measuring the range of voltage fluctuation between the anode and cathode. When, however, the electrode and/or electrolyzer will not return to a normal state in spite of such operation as decreasing the current application, the abnormality may generally have begun from a part of the whole number of electrode plates. Therefore, by employing a plurality of power sources and measuring the range of electrolytic voltage fluctuation between the anode and cathode of each current collector unit for each of the respective power sources, it becomes possible to specify the site of abnormality occurrence with ease. Once the abnormality site can be specified, it becomes possible to operate the power source connected to the abnormality site alone according to the degree of abnormality while operating the other power sources under predetermined ordinary conditions. Thus, by increasing the number of electrolytic power sources but decreasing the capacity of each of the respective power sources relative to the current capacity of the generator, it becomes possible to finely control the generator depending on the respective states of the plurality of electrodes.

The apparatus, or system, for current control in gas generators generating a fluorine or fluoride gas according to the invention comprises a carbon electrode for electrolyzing an electrolytic bath comprising a hydrogen fluoride-containing mixed molten salt, a constant current supply source for current application between the anode and cathode, current control means connected with the constant current supply source and serving to control the current applied, first measuring means for measuring the time from the start of electrolytic current application, voltage measuring means for measuring the fluctuation in the voltage between the anode and cathode after the lapse of a predetermined period of time as measured by the first measuring means, second measuring means for measuring the period of time of the voltage fluctuation range measurement, and current determining means for determining the current to be applied next based on the range of voltage fluctuation between the anode and cathode.

When, in fluorine electrolysis, a certain current is applied between the anode and cathode, the electrolytic voltage initially fluctuates excessively even in a normal state of electrolysis and then shows an almost constant value depending on the current applied. Therefore, as shown in FIG. 3, the first measuring means (timer 1) is used to measure a certain period of time during which the range of electrolytic voltage fluctuation between the anode and cathode should be neglected so that the initial excessive fluctuation may not be detected as an abnormality (ST-3). This time, when it is excessively long, will fail to detect abnormalities and, when it is excessively short, the initial voltage fluctuation range after the start of current application will be detected as an abnormality. Therefore, a specific measurement time can be selected within the range of 1 second to 5 minutes, preferably 6 seconds to 1 minute. After time measurement by this first measuring means, the measurement of the range of voltage fluctuation between the anode and cathode is started. The period of time of this measurement is measured by the second measuring means (timer 2). When it is too short, the change in electrolytic voltage becomes relatively slow, hence cannot be detected, rendering it difficult to succeed in abnormality detection and, when it is too long, it may become too late to take measures against the abnormality occurrence or an unnecessarily long period may be required until the next application of a constant current, hence the productivity may become poor. Therefore, a specific measurement time should be selected within the range of 1 second to 120 minutes, preferably 3 minutes to 30 minutes.

As for the range of electrolytic voltage fluctuation between the anode and cathode, the voltage at the time of the start of the voltage measurement period by the second measuring means is taken as a "reference voltage" and the difference of the voltage at the time of the end of the voltage measurement period from that reference voltage is regarded as the range of electrolytic voltage fluctuation. Based on the results of past studies of operation conditions, the range of electrolytic voltage fluctuation between the anode and cathode upon application of a constant current can be divided into and judged as being in a normal range (ST-5), a warning range (ST-6) and an abnormality range (ST-7). Although these may vary depending on the shape of the electrolyzer and the electrolysis controlling conditions, the range of "reference voltage ±0 to 0.5 V", preferably the range of "reference voltage ±0 to 0.3 V", may be regarded as the normal fluctuation range, the value outside the normal range but in the range of "reference voltage ±0.2 to 1.0 V", preferably "reference voltage ±0.3 to 0.5 V", may be regarded as belonging to the warning range, and the "value outside the warning range" may be regarded as belonging to the abnormality range. If these values are selected so that the fluctuation range width may be too small, however, a fluctuation within the normal range may be judged to be abnormal and the operation may be disturbed thereby. If it is too great, the occurrence of an abnormality may not be detected or it may become difficult to improve the electrolysis state to return to normalcy.

When the range of electrolytic voltage fluctuation as shown in FIG. 2 is measured by the first measuring means, the second measuring means and the means for measuring the electrolytic voltage between the anode and cathode and found to be within the normal range, a certain current is further applied (ST-2), the same measurements are repeated and, finally, current application is carried out until the operation current level intended of the power source employed in the gas generator for generating a fluorine or fluoride gas to thereby generate a required amount of a fluorine or fluoride gas. If the range of electrolytic voltage fluctuation between the anode and cathode is in the warning range, further electrolytic current application (ST-6) is suspended, the electrolytic voltage fluctuation range measurement is repeated by the first measuring means, the second measuring means and the means for measuring the electrolytic voltage between the anode and cathode (ST-6, ST-7) and, when the fluctuation range can be judged to be within the normal range based on the measurement results, further electrolytic current application is restarted. If the range of electrolytic voltage fluctuation is in the abnormality range (ST-7), the constant electrolytic current applied previously is reduced to the level before application, the electrolytic voltage fluctuation range measurement is carried out using the first measuring means, the second measuring means and the means for measuring the electrolytic voltage between the anode and cathode and, when the fluctuation can be judged to be within the normal range based on the measurement results, electrolytic current application is restarted. When the fluctuation is judged to be in the warning range, the warning range procedure mentioned above is followed. When an apparatus, or system, having all of these functions is used, it is possible to select a target operation current value and automatically apply an electric current in constant amounts between the anode and cathode until the intended current amount is reached and, after arrival at the intended current amount, automatic operation is still possible by continuing the current control in the same manner. It becomes also possible to allow the electrolysis conditions to proceed always stably. In case of abnormality occurrence during operation, the abnormality can be detected early depending on the results of measurement of the range of electrolytic voltage fluctuation between the anode and cathode and the operation condition can be prevented from worsening by adjusting the current amount.

In a further aspect of the apparatus for current control in gas generators generating a fluorine or fluoride gas according to the invention, there are provided a plurality of constant current supply sources.

By employing a plurality of constant current supply sources and measuring the range of electrolytic voltage fluctuation between the anode and cathode of each current collector unit for the respective power sources, it becomes easy to specify the site of abnormality occurrence. Once the abnormality site can be specified, it becomes possible to operate the power source connected to the abnormality site alone according to the degree of abnormality while operating the other power sources under predetermined ordinary conditions. Thus, by increasing the number of electrolytic power sources but decreasing the capacity of each of the respective power sources relative to the current capacity of the generator, it becomes possible to finely control the generator depending on the respective states of the plurality of electrodes.

DETAILED DESCRIPTION OF PREFERRED EMBODIMENTS

Figure 1:
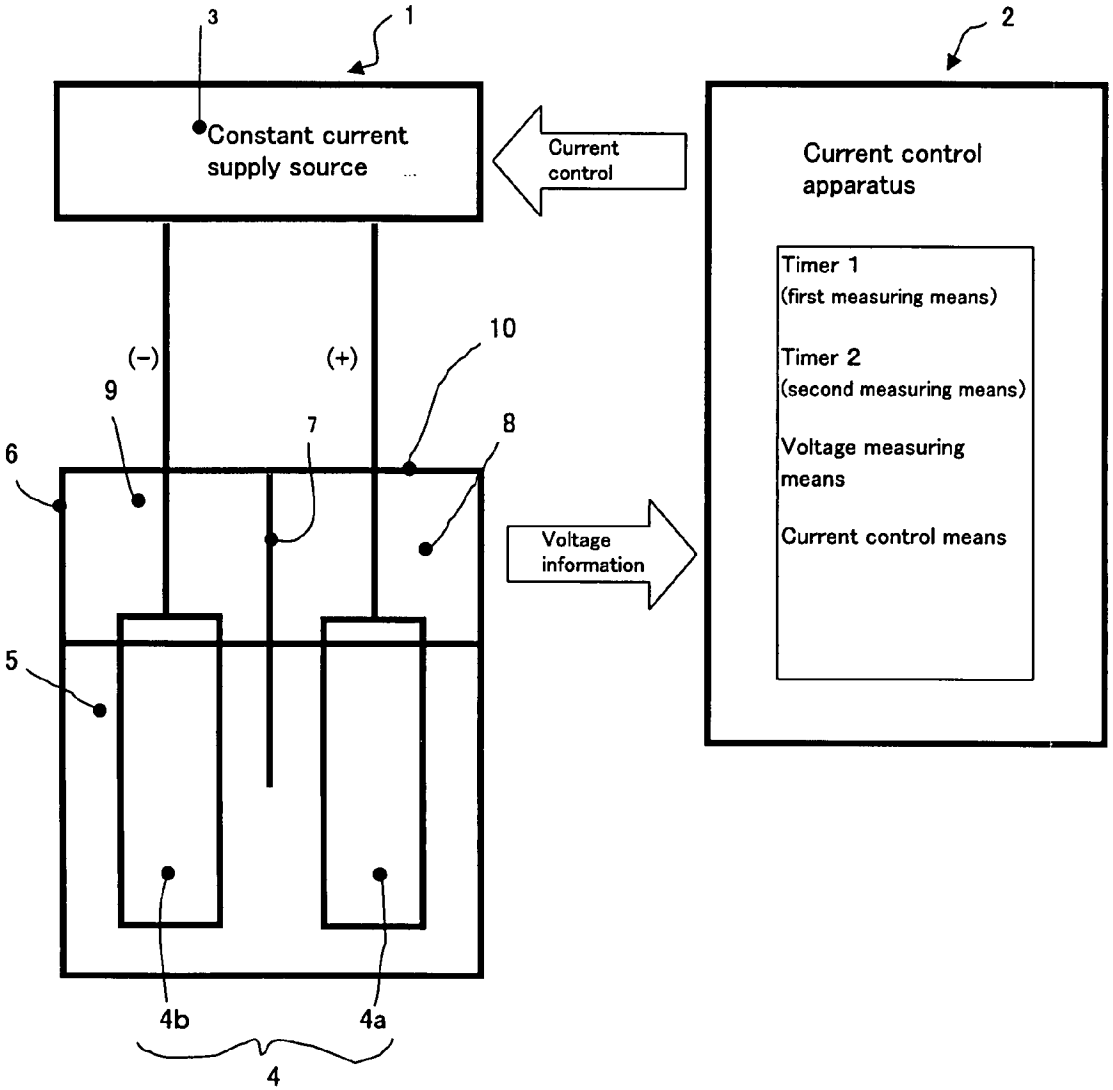
FIG. 1 is a schematic representation of the main parts of an embodiment of the gas generator according to the invention.

In the following, a mode of embodiment of the method of current control in gas generators according to the invention is described referring to the drawings. FIG. 1 is a schematic representation of the gas generator according to the invention. As shown in FIG. 1, the gas generator according to the invention comprises, as main constituent elements thereof, a gas generator portion 1 comprising a constant current supply source 3, and a current control apparatus or system 2 connected to the constant current supply source 3 and serving to control the current to be applied to the electrodes 4.

The gas generator portion 1 comprises the constant current supply source 3 connected to the electrodes 4 constituted of an anode 4*a*, which is a carbon electrode, and a cathode 4*b*, and an electrolytic cell or electrolyzer 6 in which an electrolytic bath 5 comprising a hydrogen fluoride-containing mixed molten salt, for instance, is to be contained. The electrolyzer 6 is made of such a metal as Ni, Monel, pure iron or stainless steel. The electrolyzer 6 is divided into an anode chamber 8 and a cathode chamber 9 by means of a partition wall 7 made of Ni or Monel. Ni, among others, is used as the cathode. The electrolyzer 6 is provided with temperature adjusting means (not shown) for heating the electrolyzer inside. The top cover 10 of the electrolyzer 6 is provided with gas discharge ports for discharging gases generated, upon electrolysis, from the anode and cathode, respectively.

The current control apparatus 2 is connected to the constant current supply source 3 and is constituted of current control means for controlling the current to be applied to a predetermined target current amount, first measuring means for measuring a predetermined period of time after application of a certain predetermined current amount, voltage measuring means for measuring the range of voltage fluctuation between the anode 4*a* and cathode 4*b* after the lapse of that predetermined period of time, second measuring means for measuring a predetermined voltage measurement time, and current determining means for judging as to whether the range of voltage fluctuation between the anode and cathode is normal or not and determining, based on this judgment result, the amount of electric current to be applied then.

Figure 4:
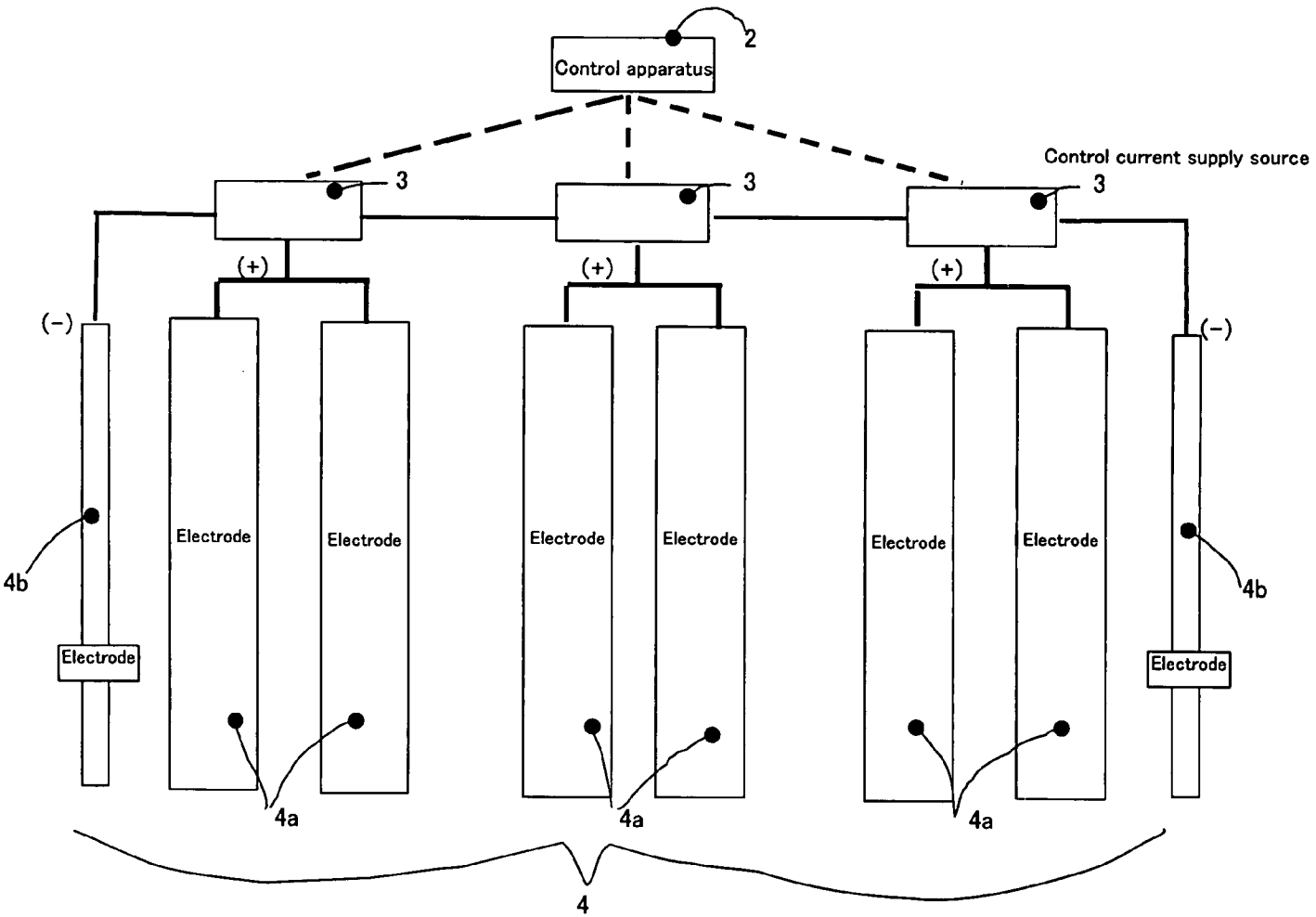
FIG. 4 is an illustration of another embodiment of the gas generator according to the invention.

Here, as regards the constant current supply source 3, it is possible to supply the total current amount dividedly to respective sets 4 of electrodes (anodes), including anodes 4*a* and cathodes 4*b*, independently via the corresponding plurality of constant current sources, as shown in FIG. 4. In this way, the current amounts applied to the respective sets 4 of electrodes (anodes) can be controlled separately. Even when any of the sets 4 of electrodes (anodes) cannot be used due to some abnormality that has occurred during electrolysis or other unexpected abnormality, the other electrode sets 4 that are still usable can be used to continue electrolysis; thus, even when there is some abnormality in the electrolyzer, the electrolyzer can be operated stably while minimizing the influence of the abnormality. Further, in coping with the abnormality, it is only necessary to care for the electrode set 4 in an abnormal condition alone and thereafter restart the same. Thus, the electrode set 4 after abnormality occurrence can be started under mild conditions while the normal electrode sets 4 can be started relatively more quickly; in other words, the former electrode set and the latter sets can be operated under separate conditions, resulting in an improvement in maintainability. It is of course possible to use only one power source for a plurality of electrode sets 4.

Figure 2:
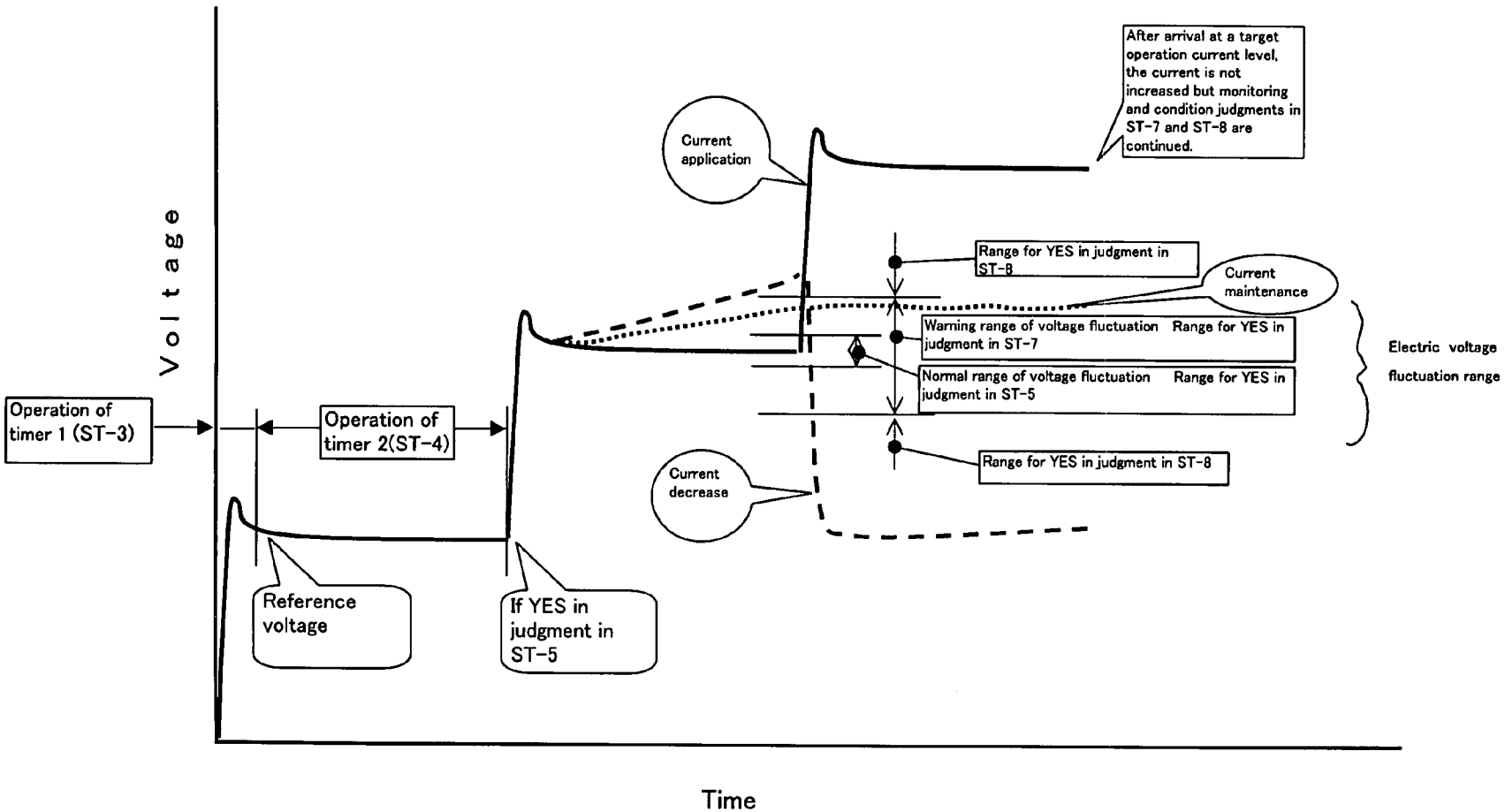
FIG. 2 is an illustration of the relationship between applied current and voltage in the gas generator according to the invention.
Figure 3:
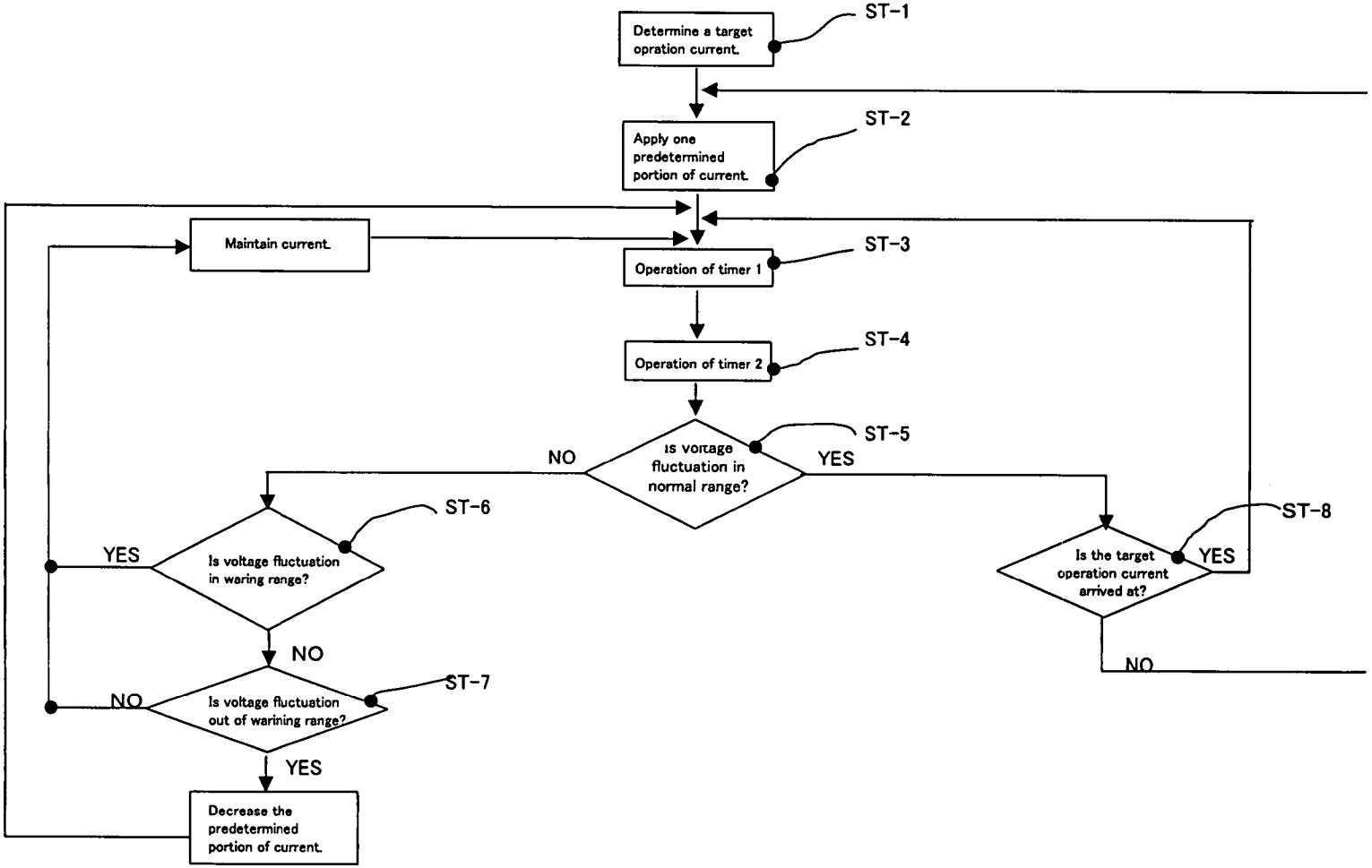
FIG. 3 is a flowchart illustrating the process for current application to the electrodes.

The method of current control in the fluorine gas generator constituted in the above manner is now described referring to FIG. 2 and FIG. 3.

First, a maximum current necessary for operation is determined according to the capacity of the electrolyzer 6 (FIG. 3, ST-1). Then, a certain constant current to be applied in each of a plurality of steps is determined so that the maximum current may be attained after the plurality of current application, and the current for one step is applied (FIG. 3, ST-2). The current amount to be applied in one step is selected at a level of not greater than 5 A/dm$^2$, preferably within the range of 1 to 3 A/dm$^2$, relative to the anode surface area effective for electrolysis. The current application is carried out in one or more steps, preferably in three or more steps, until arrival at the target maximum operation current. In this manner, even when a carbon electrode is used as the anode 4*a*, the anode effect can be inhibited from manifesting itself or, if the anode effect manifests itself, the progress of that phenomenon can be suppressed by selecting the current density at a lower level; thus, the electrolyzer can be operated safely by controlling current application or reducing the current amount at the time of judgment to the effect that the range of electrolytic voltage fluctuation between the anode and cathode is abnormal. When the certain constant current is applied, the electrolytic voltage between the anode and cathode onec rises and, after arrival at a peak, lowers to a lesser extent as compared with the rise and then settles, as shown in FIG. 2. Therefore, the timer 1, which is the first measuring means, is operated so that the voltage fluctuation during a period of 0.1 to 10 minutes just after current application starting, during which the voltage fluctuation is great, may be disregarded (FIG. 3, ST-3). After the lapse of the predetermined period of time as set by the timer 1, the timer 2, which is the second measuring means and monitors the range of voltage fluctuation between the anode 4*a* and cathode 4*b*, operates (FIG. 3, ST-4).

The voltage between the anode and cathode at the time of the start of the voltage measurement period by the timer 2 is taken as a "reference voltage", and the difference of the voltage at the time of the ending of the period of voltage measurement by the timer 2 from that reference voltage is regarded as the range of electrolytic voltage fluctuation. The voltage fluctuation range is judged as to whether it is in a normal range, namely the range of "reference voltage ±0 to 0.5 V", preferably the range of "reference voltage ±0 to 0.3 V" (FIG. 3, ST-5). If the voltage fluctuation is within the normal range, the step ST-8 in FIG. 3 is taken. The step ST-2 in FIG. 3 is again taken, and this step is repeated until arrival at the predetermined upper limit current. And, in the step ST-8 in FIG. 3, it is judged whether that current is the predetermined target operation current or not. If it is the target operation current, electrolysis is continued by maintaining current application while monitoring the electrolytic voltage fluctuation range (FIG. 3, ST-3). If it is not yet the target operation current, the step ST-2 in FIG. 3 is again taken to return to the next current application step (B in FIG. 2), the constant current is further applied, and the step is repeated.

If, in the step ST-5 in FIG. 3, the voltage fluctuation is outside the normal range, the step ST-5 in FIG. 3 is taken and judgment is made as to whether the voltage fluctuation is in the warning range, namely the range of "reference voltage ±0.2 to 1.0 V", preferably "reference voltage ±0.3 to 0.5 V" (ST-5 in FIG. 3). If the voltage fluctuation is in the warning range, the current is maintained according to the step ST-6 in FIG. 3, the step ST-4 in FIG. 3 is again taken, and this step is repeated. If the voltage fluctuation is outside the warning range, it is judged as belonging to the "abnormality range", the current is decreased according to the step ST-7 in FIG. 3, the step ST-3 (FIG. 3) is again taken, and this step is repeated.

By repeating these operations, it becomes possible to automatically operate the gas generator for generating a fluorine or fluoride gas always safely and dependably. The above-mentioned steps can be performed in the conventional manner, for example in the manner of sequence control.

The present invention, which has the constitution described above, makes it possible to automatically control the current application to the carbon anode in gas generators for generating a fluorine or fluoride gas by electrolysis of a hydrogen fluoride-containing electrolytic bath. In the conventional gas generators for industrial use, the operators are required to be skilled and, in case of abnormality occurrence, detailed judgment of conditions is required for modifying the operation conditions and much cost and labor are required for stopping the gas generators for maintenance thereof. By using the method and apparatus for current control as invented by the present inventors, it becomes possible to stably operate gas generators for generating a fluorine or fluoride gas and, in case of abnormality occurrence, it is possible to automatically cope with the abnormality and minimize the influence of the abnormality.

What is claimed is:

1. A method of current control in a gas generator generating a fluorine or fluoride gas by electrolysis of an electrolytic bath comprising a hydrogen fluoride-containing mixed molten salt using a carbon electrode as an anode which method comprises:

measuring a range of voltage fluctuation between a cathode and the anode when a certain constant current is applied to the gas generator; and applying current while varying the current amount being applied according to the measured voltage fluctuation range.

2. A method of current control in a gas generator generating a fluorine or fluoride gas by electrolysis of an electrolytic bath comprising a hydrogen fluoride-containing mixed molten salt using a carbon electrode as an anode which method comprises:

measuring a range of voltage fluctuation between a cathode and the anode when a certain constant current is applied to the gas generator; and applying current to the gas generator until arrival at a target operation current level while varying the current amount being applied according to the measured voltage fluctuation range.

3. The method of current control in a gas generator generating a fluorine or fluoride gas as set forth in claim 2, wherein the range of voltage fluctuation between the anode and the cathode is measured and the current amount being applied is varied according to the measured voltage fluctuation range to thereby continue the electrolysis further after arrival of the current being applied at the target operation current level.

4. The method of current control in a gas generator generating a fluorine or fluoride gas as set forth in claim 2 or claim 3, wherein current is applied until a predetermined value level while repeatedly increasing, decreasing or maintaining the current being applied.

5. The method of current control in a gas generator generating a fluorine or fluoride gas as set forth in any of claims 1 to 3, wherein the current being applied at a time is not more than 5 $A/dm^2$ relative to an effective electrolysis surface area on the anode.

6. A method of current control in a gas generator generating a fluorine or fluoride gas as set forth in any of claims 1 to 3, wherein the gas generator has a plurality of independent power sources.

7. An apparatus for current control in a gas generator generating a fluorine or fluoride gas which comprises:

a carbon electrode for electrolyzing an electrolytic bath comprising a hydrogen fluoride-containing mixed molten salt;

a constant current supply source for applying current between an anode and a cathode;

current control means connected with the constant current supply source and serving to control the current applied;

first measuring means for measuring elapsed time from a start of applying electrolytic current;

voltage measuring means for measuring a fluctuation in the voltage between the anode and the cathode after elapse of a predetermined period of time as measured by the first measuring means second measuring means for measuring a period of time of the voltage fluctuation range measurement; and current determining means for determining the current to be applied next based on the range of voltage fluctuation between the anode and the cathode.

8. The apparatus for current control in a gas generator generating a fluorine or fluoride gas as set forth in claim 7, wherein the constant current supply source comprises a plurality of constant current supply sources.

* * * * *